US007735696B2

(12) United States Patent
Allsop

(10) Patent No.: US 7,735,696 B2
(45) Date of Patent: Jun. 15, 2010

(54) METERING VALVE

(75) Inventor: Paul Allsop, Norfolk (GB)

(73) Assignee: Consort Medical plc, Hertfordshire (GB)

( * ) Notice: Subject to any disclaimer, the term of this patent is extended or adjusted under 35 U.S.C. 154(b) by 374 days.

(21) Appl. No.: 10/554,790

(22) PCT Filed: Apr. 30, 2004

(86) PCT No.: PCT/GB2004/001891

§ 371 (c)(1),
(2), (4) Date: Oct. 28, 2005

(87) PCT Pub. No.: WO2004/096666

PCT Pub. Date: Nov. 11, 2004

(65) Prior Publication Data

US 2007/0017936 A1 Jan. 25, 2007

(30) Foreign Application Priority Data

Apr. 30, 2003 (GB) ..... 0309936.3
Apr. 30, 2003 (GB) ..... 0309940.5

(51) Int. Cl.
*B65D 83/00* (2006.01)

(52) U.S. Cl. ..... 222/402.2

(58) Field of Classification Search ..... 222/402.2, 222/402.1, 401, 402, 402.23, 402.22, 402.24, 222/402.11, 402.25, 402.19
See application file for complete search history.

(56) References Cited

U.S. PATENT DOCUMENTS 3,055,560 A * 9/1962 Meshberg ..... 222/402.2
3,104,785 A * 9/1963 Beard, Jr. ..... 222/207
3,591,059 A * 7/1971 Stearns ..... 222/402.2
4,819,834 A * 4/1989 Thiel ..... 222/355
4,953,759 A * 9/1990 Schmidt ..... 222/402.2
6,006,954 A * 12/1999 Warby ..... 222/342
6,474,513 B2 * 11/2002 Burt ..... 222/402.1
6,510,969 B2 * 1/2003 Di Giovanni et al. .... 222/402.2
6,622,896 B2 * 9/2003 Hegeman et al. ..... 222/651
7,086,571 B2 * 8/2006 Warby et al. ..... 222/402.1
7,278,556 B2 * 10/2007 Goujon et al. ..... 222/402.1
2002/0190477 A1 12/2002 Leone et al.
2003/0141322 A1 * 7/2003 Groeger ..... 222/402.1
2006/0237487 A1 10/2006 Allsop
2007/0007308 A1 1/2007 Allsop

FOREIGN PATENT DOCUMENTS

EP 0 870 699 A2 10/1998
EP 1 386 858 2/2004
FR 1 287 373 12/1962
FR 1 598 257 7/1970
FR 2 074 647 10/1971
GB 798683 8/1954
GB 897461 5/1962
GB 957 294 5/1964

(Continued)

*Primary Examiner*—Kevin P Shaver
*Assistant Examiner*—Stephanie E Tyler
(74) *Attorney, Agent, or Firm*—Smith, Gambrell & Russell, LLP

(57) ABSTRACT

The present invention relates to a metering valve comprising a valve stem (11) co-axially slidable within a valve body (14), the metering valve comprising a metering chamber (13), wherein the metering chamber is constructed wholly from rigid components.

38 Claims, 5 Drawing Sheets

FOREIGN PATENT DOCUMENTS

| | | | | |
|---|---|---|---|---|
| GB | 1 108 510 | | | 4/1968 |
| GB | 1 162 684 | | | 8/1969 |
| GB | 1 310 161 | | | 3/1973 |
| GB | 2 178 398 | | | 2/1987 |
| GB | 2198117 | A | * | 6/1988 |
| GB | 2 326 156 | | | 12/1998 |
| GB | 2 361 228 | A | | 10/2001 |
| GB | 2361229 | A | | 10/2001 |
| GB | 2 367 809 | | | 4/2002 |
| GB | 2 377 694 | | | 1/2003 |
| WO | WO 99/54230 | | | 10/1999 |
| WO | 01/10741 | A1 | | 2/2001 |
| WO | 01/10742 | A1 | | 2/2001 |
| WO | WO 092467 | | | 11/2002 |
| WO | WO 03/013984 | | | 2/2003 |
| WO | 03/039996 | A1 | | 5/2003 |
| WO | 03/057594 | A | | 7/2003 |
| WO | WO 2004/096667 | | | 11/2004 |
| WO | WO 2004/096668 | | | 11/2004 |

* cited by examiner

METERING VALVE

The present invention relates to improvements in valves for pressurised dispensing containers.

Pressurised dispensing containers are used for dispensing a wide variety of products. The pressurised dispensing container is provided with a valve for controlling actuation of the container. The valve may be a continuous flow valve or alternatively a metering valve in which, upon each actuation of the valve, a metered quantity of product is dispensed.

The product stored in the pressurised metering chamber typically comprises a propellant and an active ingredient as well as other subsidiary constituents such as solvents, co-solvents and other constituents as known in the art. The propellant is typically a liquified propellant having a sufficiently high vapour pressure at normal working temperatures to propel the product through the valve on actuation by volatilisation of the propellant. Suitable propellants include, for example, hydro-carbon or fluoro-carbon propellants. In particular, presently preferred propellants include HFA134a and HFA227. The active ingredient may be any constituent which requires dispensing. Pressurised dispensing containers have found wide-spread use for dispensing active ingredients in the form of pharmaceutical medicaments where the medicament is contained in the container in the form of, for example, a solution or a suspension in the liquified propellant.

Conventional metering valve for use with pressurised dispensing containers typically comprise a valve stem co-axially slidable within a chamber body defining a metering chamber. "Inner" and "outer" annular seals are operative between the valve stem and the chamber body to seal the metering chamber therebetween. The valve stem is generally movable against the action of a spring from a non-dispensing position, in which the metering chamber communicates with bulk product stored in the container, to a dispensing position, in which the metering chamber is isolated from the bulk product and instead is vented to atmosphere so as to discharge the metered quantity of product held in the metering chamber.

To use a pressurised dispensing container comprising a metering valve as described above, a user first inverts the pressurised dispensing container so that the metering valve is lowermost (the actuation position) and shakes the apparatus to agitate the product. The agitation helps to homogenises the product before actuation. This is particularly important where the product comprises a suspension since such suspensions may be prone to 'settling' over time leading to differences in the concentration of the medicament throughout the volume of the pressurised dispensing container. The pressurised dispensing container is then actuated by depressing the valve stem relative to the pressurised dispensing container into the dispensing position. The product in the metering chamber is then vented to atmosphere where it is, for example, inhaled by the user. On release of the valve stem, the spring restores the valve stem to the non-dispensing position, whereby the metering chamber is re-charged with product from the bulk product stored in the pressurised dispensing container.

A concern with such pressurised dispensing containers, particularly where they are used to dispense pharmaceutical medicaments, is the accuracy of the delivered dose. Variation in the dose can lead to a user receiving too little or too much medicament. The accuracy of the dosage dispensed is affected by, amongst other factors, the volume of the metering chamber. Variation in the volume of the metering chamber will lead to variation in the metered dose volume. In typical metering valves the metering chamber is bounded in part by the inner and/or outer seals. For example the upper or lower face of the metering chamber may be formed, in part or in whole, by the seal surface. It has been found that the volume of the metering chamber can be altered due to the deflection and/or distortion and/or swelling of these seals. Deflection and distortion of the seals can occur due to the action of the valve stem as it slides to and fro relative to the seals. One example is the metering valve of GB2361229A wherein first and second elastomeric seals are provided for sealing a metering chamber. Whilst a rigid insert 52 is provided within the chamber this does not wholly define the construction of the metering chamber and does not prevent flexure and distortion of the seals on movement of the valve stem, in particular in directions away from the mid-point of the chamber, i.e. when the outer first seal is flexed downwardly on depression of the valve stem.

Swelling of the seals can potentially occur where the seal material is reactive with any of the constituents of the product contained in the pressurised dispensing container.

According to the present invention, there is provided a metering valve comprising a valve stem co-axially slidable within a valve body, the metering valve comprising a metering chamber, wherein the metering chamber is constructed wholly from rigid components.

Advantageously, the use of rigid components to construct the metering chamber allows a more accurate volume of metering chamber to be produced. The rigid components are not liable to deflection or distortion during use. The absence of seal materials bounding the metering chamber reduces the likelihood of adverse reactions with the product.

Preferably, the metering chamber is constructed wholly from components formed from one or more materials selected from polyester, nylon, acetal, or the like, stainless steel, ceramics, glass, or the like.

The metering valve may further comprise inner and outer seals external to the metering chamber.

Advantageously, the metering chamber may be constructed from only two rigid components. This helps to reduce the number of components whose tolerance affects the volume of the metering chamber. In this way the variability in the volume of the metering chamber between valves and between batches of valves is reduced.

Preferably, the components of the metering chamber comprises one or more stops for limiting axial movement of the valve stem therethrough.

In one embodiment the metering chamber surrounds the valve stem. The metering chamber may be annular.

The valve body may define a radially outermost surface of the metering chamber.

The metering valve may further comprise an internal sleeve. The internal sleeve is located concentrically within the valve body. Preferably, the internal sleeve surrounds the valve stem. Advantageously, the internal sleeve separates the metering chamber from the valve stem.

The metering chamber may be formed between the valve body and the internal sleeve.

The internal sleeve may define a radially innermost surface of the metering chamber.

Preferably, the internal sleeve comprises a cylindrical portion.

Preferably, the internal sleeve comprises one or more ports for passage of a product into or out of the metering chamber. Preferably, the one or more ports function as both an inlet to, and an outlet from, the metering chamber in use.

Preferably, the inner seal is carried on the valve stem in sliding sealing contact with a radially innermost surface of the internal sleeve, being external the metering chamber.

A radially directed flange of the internal sleeve may define an outer end surface of the metering chamber.

A radially directed flange of the valve body may define an inner end surface of the metering chamber.

In another embodiment, the metering chamber is located within the valve stem such that product held in the metering chamber is dischargeable directly into the valve stem. Preferably, the metering chamber is cylindrical.

Preferably, the metering chamber comprises one or more ports which function as both an inlet to, and an outlet from, the metering chamber in use. Preferably, the one or more ports are static.

Preferably, the one or more ports are located at an inner end of the metering chamber.

The metering valve may further comprise a seal which is movable relative to the metering chamber to close off said one or more ports, wherein said seal is external to said metering chamber. The seal preferably surrounds said metering chamber.

The metering chamber may be constructed from an open-ended chamber body and a plug. Preferably, the chamber body is substantially located within the valve stem.

Advantageously, the metering chamber has no moving parts therein.

The metering chamber may have a volume of up to 300 microlitres. Preferably, the volume is up to 25 microlitres. Advantageously, the metering chamber may have a volume of 10 to 25 microlitres.

Advantageously, the absence of moving parts within the metering chamber allows a chamber to be produced with a very small volume less than 25 microlitres. The absence of moving parts also provides for a more accurate volume of the metering chamber since the metering chamber volume is defined by fewer components.

In the following description and claims "inner" and "outer" are used to describe relative positions of components of the metering valve which are respectively further from or nearer to an outer end 19 of valve stem 11 as shown in the Figures.

The valve may be for use in a pharmaceutical dispensing device, such as, for example, a pulmonary, nasal, or sublingual delivery device. A preferred use of the valve is in a pharmaceutical metered dose aerosol inhaler device. The term pharmaceutical as used herein is intended to encompass any pharmaceutical, compound, composition, medicament, agent or product which can be delivered or administered to a human being or animal, for example pharmaceuticals, drugs, biological and medicinal products. Examples include anti-allergics, analgesics, bronchodilators, antihistamines, therapeutic proteins and peptides, antitussives, anginal preparations, antibiotics, anti-inflammatory preparations, hormones, or sulfonamides, such as, for example, a vasoconstrictive amine, an enzyme, an alkaloid, or a steroid, including combinations of two or more thereof. In particular, examples include isoproterenol [alpha-(isopropylaminomethyl)protocatechuyl alcohol], phenylephrine, phenylpropanolamine, glucagon, adrenochrome, trypsin, epinephrine, ephedrine, narcotine, codeine, atropine, heparin, morphine, dihydromorphinone, ergotamine, scopolamine, methapyrilene, cyanocobalamin, terbutaline, rimiterol, salbutamol, flunisolide, colchicine, pirbuterol, beclomethasone, orciprenaline, fentanyl, and diamorphine, streptomycin, penicillin, procaine penicillin, tetracycline, chlorotetracycline and hydroxytetracycline, adrenocorticotropic hormone and adrenocortical hormones, such as cortisone, hydrocortisone, hydrocortisone acetate and prednisolone, insulin, cromolyn sodium, and mometasone, including combinations of two or more thereof.

The pharmaceutical may be used as either the free base or as one or more salts conventional in the art, such as, for example, acetate, benzenesulphonate, benzoate, bircarbonate, bitartrate, bromide, calcium edetate, camsylate, carbonate, chloride, citrate, dihydrochloride, edetate, edisylate, estolate, esylate, fumarate, fluceptate, gluconate, glutamate, glycollylarsanilate, hexylresorcinate, hydrobromide, hydrochloride, hydroxynaphthoate, iodide, isethionate, lactate, lactobionate, malate, maleate, mandelate, mesylate, methylbromide, methylnitrate, methylsulphate, mucate, napsylate, nitrate, pamoate, (embonate), pantothenate, phosphate, diphosphate, polygalacturonate, salicylate, stearate, subacetate, succinate, sulphate, tannate, tartrate, and triethiodide, including combinations of two or more thereof. Cationic salts may also be used, for example the alkali metals, e.g. Na and K, and ammonium salts and salts of amines known in the art to be pharmaceutically acceptable, for example glycine, ethylene diamine, choline, diethanolamine, triethanolamine, octadecylamine, diethylamine, triethylamine, 1-amino-2-propanol-amino-2-(hydroxymethyl)propane-1,3-diol, and 1-(3,4-dihydroxyphenyl)-2-isopropylaminoethanol.

The pharmaceutical will typically be one which is suitable for inhalation and may be provided in any suitable form for this purpose, for example as a solution or powder suspension in a solvent or carrier liquid, for example ethanol, or isopropyl alcohol. Typical propellants are HFA134a, HFA227 and dimethyl ether.

The pharmaceutical may, for example, be one which is suitable for the treatment of asthma. Examples include salbutamol, beclomethasone, salmeterol, fluticasone, formoterol, terbutaline, sodium chromoglycate, budesonide and flunisolide, and physiologically acceptable salts (for example salbutamol sulphate, salmeterol xinafoate, fluticasone propionate, beclomethasone dipropionate, and terbutaline sulphate), solvates and esters, including combinations of two or more thereof. Individual isomers such as, for example, R-salbutamol, may also be used. As will be appreciated, the pharmaceutical may comprise of one or more active ingredients, an example of which is flutiform, and may optionally be provided together with a suitable carrier, for example a liquid carrier. One or more surfactants may be included if desired.

Embodiments of the present invention will now be described by way of example only, with reference to the accompanying drawings, in which.

Figure 1:
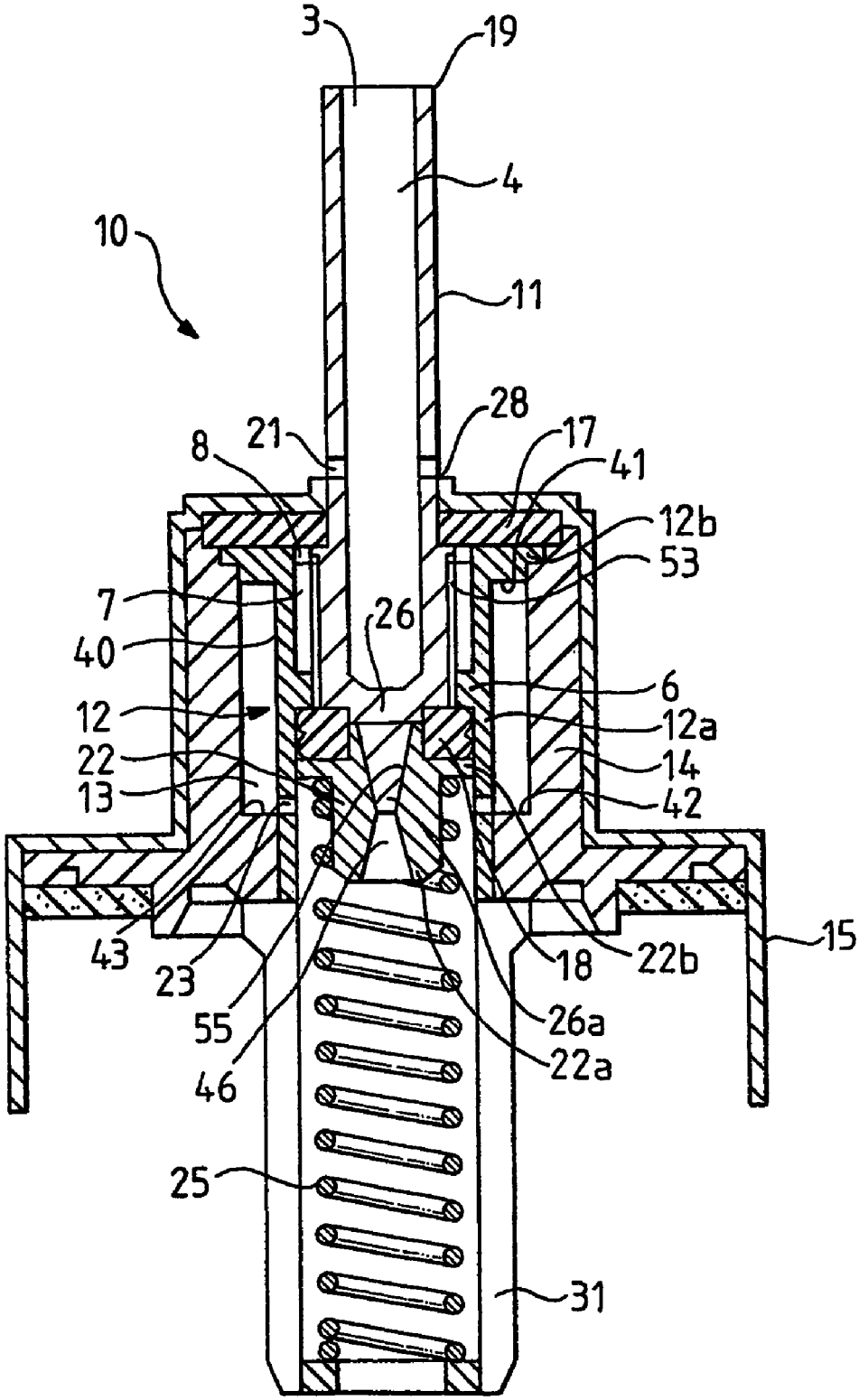
FIG. 1 is a cross-sectional view of a metering valve according to a first embodiment of the present invention in a non-dispensing position.

As shown in FIG. 1, a metering valve 10 according to a first embodiment of the present invention includes a valve stem 11 which protrudes from and is axially slidable within a valve body 14. An internal sleeve 12 is located within the valve body 14 in which sleeve 12 the valve stem 11 slides. The internal sleeve 12 and valve body 14 define therebetween an annular metering chamber 13.

The metering valve 10 is located within a canister (not shown) and closes off an open end of the canister to form a pressurised dispensing container. The valve body 14 and internal sleeve 12 are held in position with respect to the canister by means of a ferrule 15 which is crimped to the top of the canister during assembly. The pressurised dispensing container contains a product to be dispensed. Slots 31 are provided in the valve body 14 to allow passage of bulk product from within the canister into the interior of the valve body 14.

The internal sleeve 12 is generally cylindrical in shape and comprises a tubular portion 12*a* and a radially outwardly-directed flange 12*b* at its outer end. A radially outermost, external face 40 of the internal sleeve 12 defines a radially innermost, internal cylindrical surface 40 of the metering chamber 13. An upper face 41 of the metering chamber 13 is defined by an innermost face of the flange 12*b*. The valve body 14 defines an external cylindrical surface 42 and lower face 43 of the metering chamber 13. The internal sleeve 12 and valve body 14 are both formed from rigid materials such as acetal, nylon, polyester or the like.

The internal sleeve 12 is provided with one or more, preferably two, radial ports 23 which allow passage of product from an interior of the internal sleeve 12 into the metering chamber 13 and vice versa, in use, as will be described below. The radial ports 23 are located at the innermost end of the metering chamber 13 such that when the valve is inverted for use the radial ports 23 are uppermost. The size of the ports 23 is sufficient for the metering chamber 13 to rapidly fill on inversion of the valve. Locating the ports 23 at the innermost end of the chamber 13 prevents gas bubbles being trapped in the chamber 13 on inversion of the valve. After actuation the valve would be restored to the orientation shown in FIG. 1. Product is not stored in the metering chamber 13 between actuations thereby preventing dehomogenisation of the product due to settling and other effects.

The metering chamber 13 has a predefined volume for a single dosage of the product to be dispensed. Preferably, the volume of the metering chamber is between 10 and 300 microlitres. More preferably the metering chamber has a volume of 10 to 25 microlitres.

Sealing between the valve body 14 and canister is provided by an annular gasket 16. The ferrule 15 has an aperture 28 through which the valve stem 11 protrudes.

An outer seal 17, typically of an elastomeric material, extends radially between the valve stem 11 and the valve body 14. The outer seal 17 is compressed between the flange 12*b* of the internal sleeve 12, the valve stem 11, the valve body 14 and the ferrule 15 so as to provide positive sealing contact to prevent leakage of the contents of the metering chamber 13 and canister between the valve stem 11 and the aperture 28, although the seal 17 allows sliding movement of the valve stem 11 with respect to the seal 17.

The valve stem 11 defines a hollow bore 4 having a discharge outlet 3 at its outer end. The opposite end is closed off at an inner end 26. One or more discharge ports 21 extend radially through a side wall of the valve stem 11 providing communication between the bore 4 and atmosphere when the valve stem 11 is in the non-dispensing position shown in FIG. 1. The discharge port 21 is located outside the valve body 14 in the non-dispensing position of FIG. 1 but is moveable to within the valve body 14 as will be described below. The inner end 26 of the valve stem 11 is provided with a conical portion 26*a*.

Figure 4:
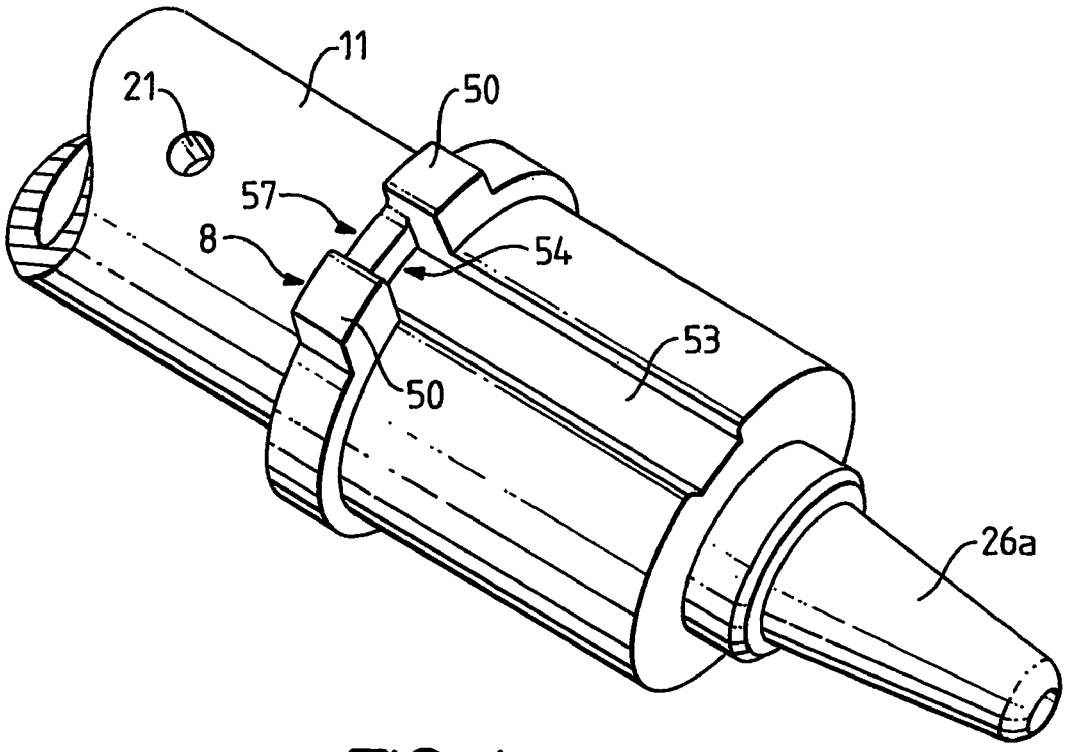
FIG. 4 is a perspective view of a part of a valve stem of the metering valve of FIG. 1.

The valve stem 11 is provided with two diametrically opposed projections 8, as most clearly shown in FIG. 4. Each projection 8 runs within a longitudinal channel 7 formed on the internal surface of the internal sleeve 12. Each projection 8 comprises two pips 50 having a gap 51 therebetween. The pips 50 extend into the channel 7. The valve stem 11 is provided with two longitudinal grooves 53 on its exterior surface aligned with the projections 8. The grooves 53 extend upwardly from the inner end of the valve stem 11 to a point slightly above the innermost face of the projections 8. Consequently, the grooves 53 form undercuts 54 in the projections 8 the purpose of which will be described below. A stop 6 is provided at the inner end of each channel 7 to limit axial movement of the valve stem 11 relative to the internal sleeve 12.

There is also provided adjacent the inner end 26 of the valve stem 11 a stem cap 22. The stem cap 22 is slidably received within the internal sleeve 12. The stem cap 22 comprises a body portion 22*a*, having a frusto-conically shaped recess 55 on its inner face, and a flange 22*b*. The recess 55 mates against the conical portion 26*a* of the valve stem 11 in the non-dispensing position of FIG. 1. A spring 25 extends between a base of the valve body 14 and the flange 22*b* to bias the stem cap 22 and valve stem 11 into the non-dispensing position, as shown in FIG. 1.

Figure 5:
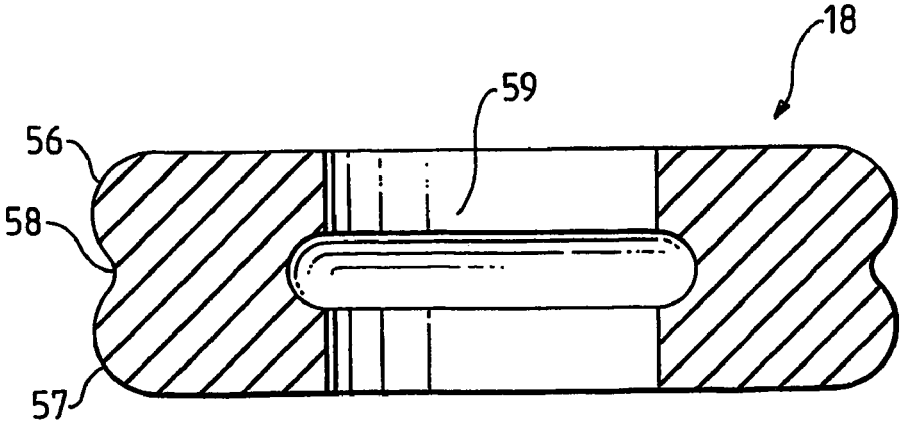
FIG. 5 is a cross-sectional view of a part of an inner seal of the metering valve of FIG. 1.

An inner seal 18 is sandwiched between the valve stem 11 and the flange 22*b* of the stem cap 22. The configuration of the inner seal 18 is shown in more detail in FIG. 5. The seal 18 is annular and is carried in use on the valve stem 11 so as to move axially therewith. The exterior face is moulded to comprise two ribs 56, 57 with a recess 58 inbetween. The internal face comprises a recess 59 which can be used to accommodate any unwanted flash produced during the moulding process so as to prevent the flash impinging on the internal sealing plane. Alternatively, the inner seal 18 may have a simplified construction without ribs so as to present a substantially uninterrupted sealing surface.

The seal 18 is preferably made of an elastomer material. The inner seal 18 seals against, in the non-dispensing position of FIG. 1, the internal sleeve 12. The inner seal 18 is slidable with respect to the internal sleeve 12 as will be discussed below.

In the non-dispensing position there is no open path from the metering chamber 13 to the bore 4 of the valve stem 11, whereas there is an open path from the interior of the canister to the metering chamber 13 via the slots 31, and radial ports 23.

In use, the pressurised dispensing container is inverted such that the valve stem 11 is lowermost in order that liquified propellant in the pressurised dispensing container collects at the end of the pressurised dispensing container adjacent the metering valve 10 so as to flow into the metering chamber 13 via the aforementioned pathway. The filling of the metering chamber 13 is very quick due to the sizing of the slots 31 and radial ports 23.

Figure 2:
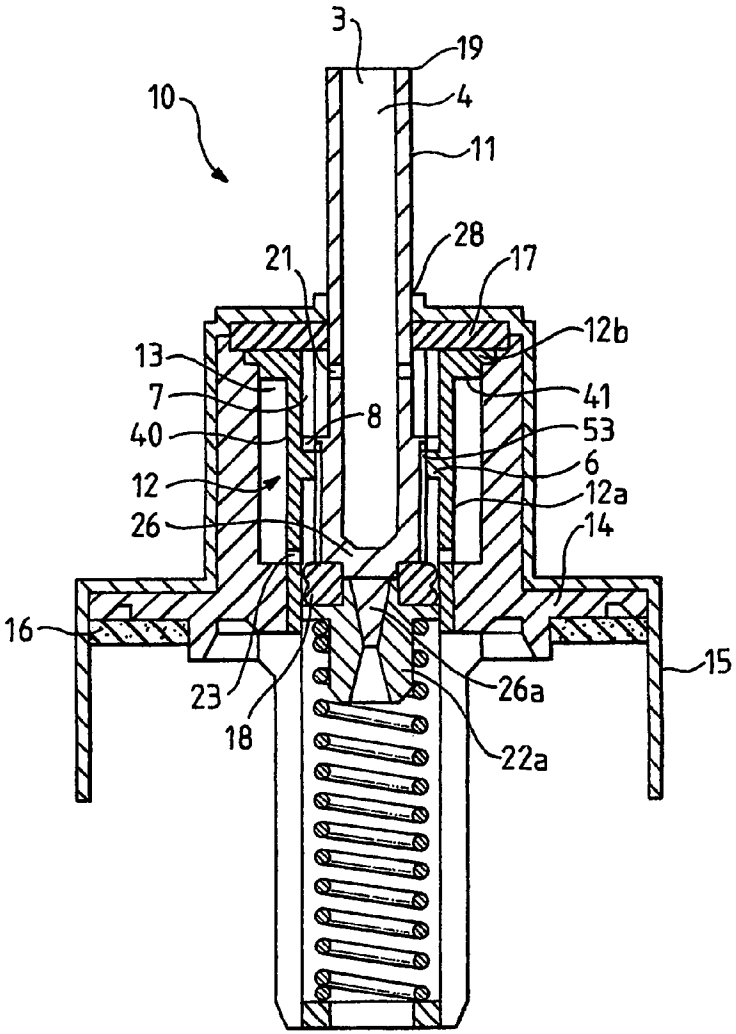
FIG. 2 is a cross-sectional view of the metering valve of FIG. 1 in a dispensing position.

Depression of the valve stem 11 relative to the internal sleeve 12 moves the valve stem 11 inwardly into the container into the dispensing position shown in FIG. 2. In the dispensing position the inner seal 18 has moved past the radial ports 23 of the internal sleeve 12 to close off communication between the bulk product in the canister and the metering chamber 13. Further movement of the valve stem 11 in the same direction to the dispensing position, as shown in FIG. 2, causes the discharge port 21 to pass through the outer seal 17 into communication with the interior of the internal sleeve 12. At this point a path to atmosphere is established for discharging the product as follows. Product within the metering chamber 13 is able to exit the metering chamber 13 though the radial ports 23 into the interior of the internal sleeve 12. From here the product flows between the internal sleeve 12 and the valve stem 11, partially along the grooves 53 up towards the projections 8. In the dispensing position of FIG. 2 the pips 50 of the projections 8 are in contact with the stops 6 of the internal sleeve 12. Product passes between the stops 6 and the projections 8 via an opening which is formed because the undercut 54 extends the grooves 53 into communication with the gap 51 formed between the pips 50. Product then traverses the channels 7 and into the bore 4 via the discharge ports 21. The product is then expelled to atmosphere via outer end 19 of the valve stem 11.

When the valve stem 11 is released, the biasing of the return spring 25 causes the valve stem 11 to return to its original non-dispensing position.

If the dispensing apparatus is returned to its upright position, as shown in FIG. 1, the product to be dispensed is free to return to the pressurised container. However, upon inversion of the apparatus into a dispensing position, the metering chamber 13 will quickly be recharged prior to the next actuation of the valve 10.

Advantageously, the inner seal 18 and the outer seal 17 are located outside the metering chamber 13 and as such are not components which form part of the construction of the metering chamber 13. Indeed in the first embodiment the metering chamber is constructed from only two components, the valve body 14 and the internal sleeve 12. The outer seal 17 is shielded from the metering chamber 13 by the flange 12*b* of the internal sleeve 12. The inner seal 18 is located within the internal sleeve on the valve stem 11 and not within the metering chamber 13 and operatively seals the radial ports 23 by closing off the radial ports 23 on the interior, radially innermost face of the internal sleeve 12 which does not form a boundary surface of the metering chamber 13. Thus, the metering chamber volume is defined much more accurately since the metering chamber is wholly formed from materials which have high resistance to distortion and/or swelling and which are rigid. A further advantage is that the metering chamber 13 does not contain any moving parts, in particular any part of the valve stem 11. This helps to maintain the integrity of the metering chamber 13. In addition, the valve of the present invention is particularly suited for very low volume metering where a small metering chamber is required. In typical metering valves moving parts within the metering chamber set a lower limit to the practical volume of the metering chamber since the moving parts (attached to the valve stem) require a minimum stroke length in order for the valve to be actuatable. At present it is extremely difficult to produce a metering chamber with a volume of less than 25 microlitres. In the valve of the present invention there is no theoretical lower limit to the volume of the metering chamber since it does not contain any moving parts. Preferably the metering chamber has a volume up to 300 microlitres. More preferably, the metering chamber has a volume up to 150 microlitres. Advantageously, the metering chamber may have a volume of up to 25 microlitres, preferably of 10 to 25 microlitres. Very low volume capacities may be accommodated by partially filling in or blocking off part of the annulus of the metering chamber so as to retain a minimum clearance distance between the radial inner and outer surfaces of the metering chamber.

Figure 3:
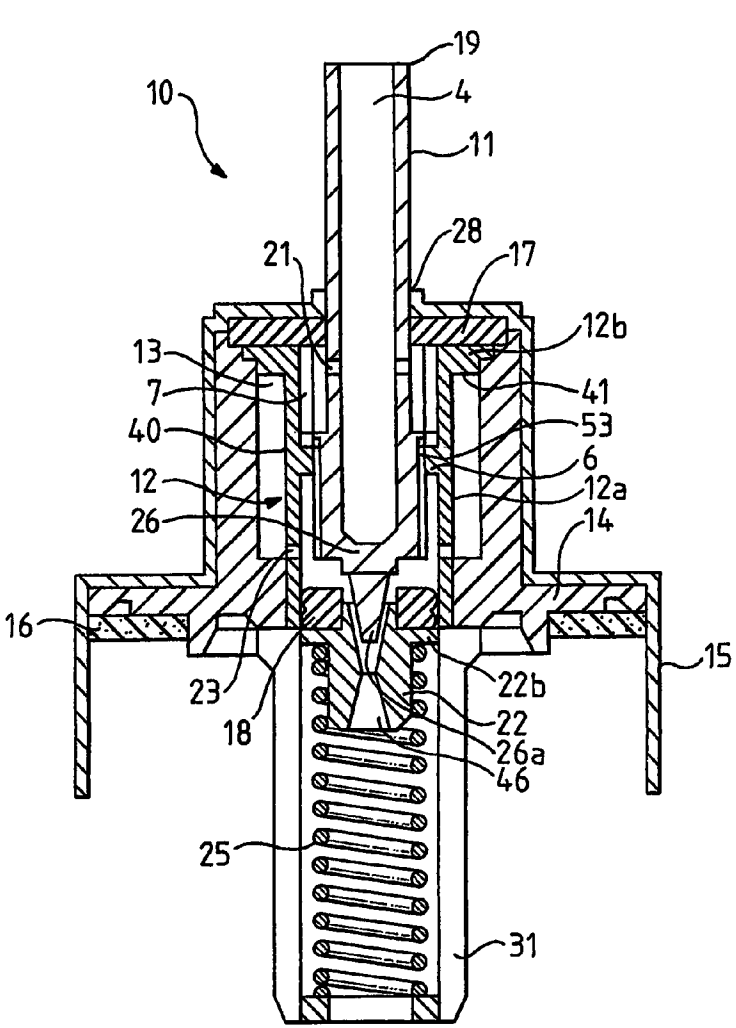
FIG. 3 is a cross-sectional view of the metering valve of FIG. 1 undergoing "pressure filling"

In order to fill the canister with product prior to the first use of the dispensing apparatus, a pressure filling method is used, during which the product is blown under pressure into the valve 10 via the outlet 3 of the valve stem 11 with the metering valve in the dispensing position. Under pressure the inner seal 18, together with the stem cap 22, are forced out of contact with the conical portion 26*a* of the valve stem 11, as shown in FIG. 3, allowing the product to pass between the inner seal 18 and the valve stem 11, through a central bore 46 formed in the stem cap 22 into the valve body 14 and thence into the container through the valve body openings 31.

Figure 6:
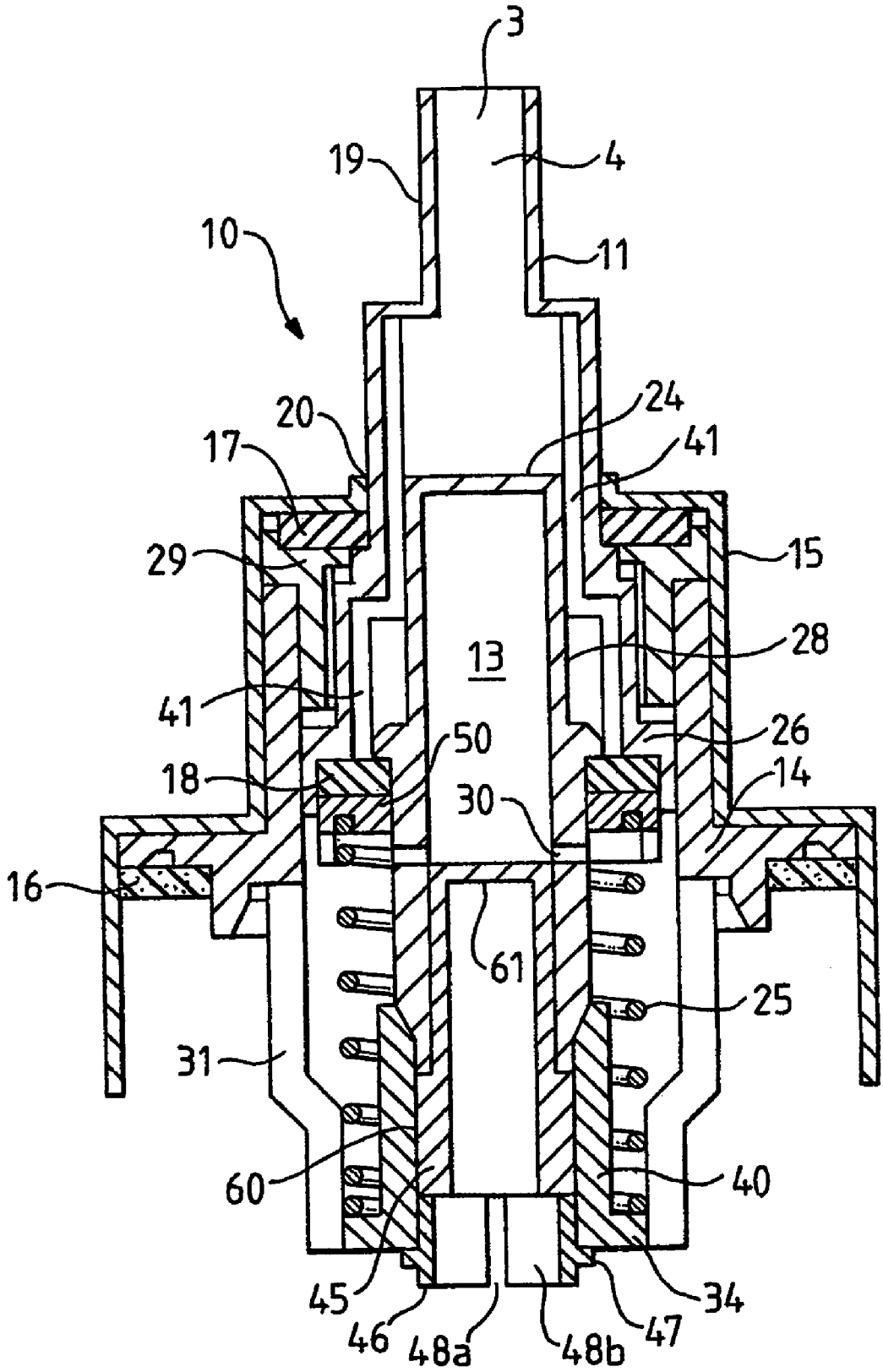
FIG. 6 is a cross-sectional view of a metering valve according to a second embodiment of the present invention in a non-dispensing position.
Figure 8:
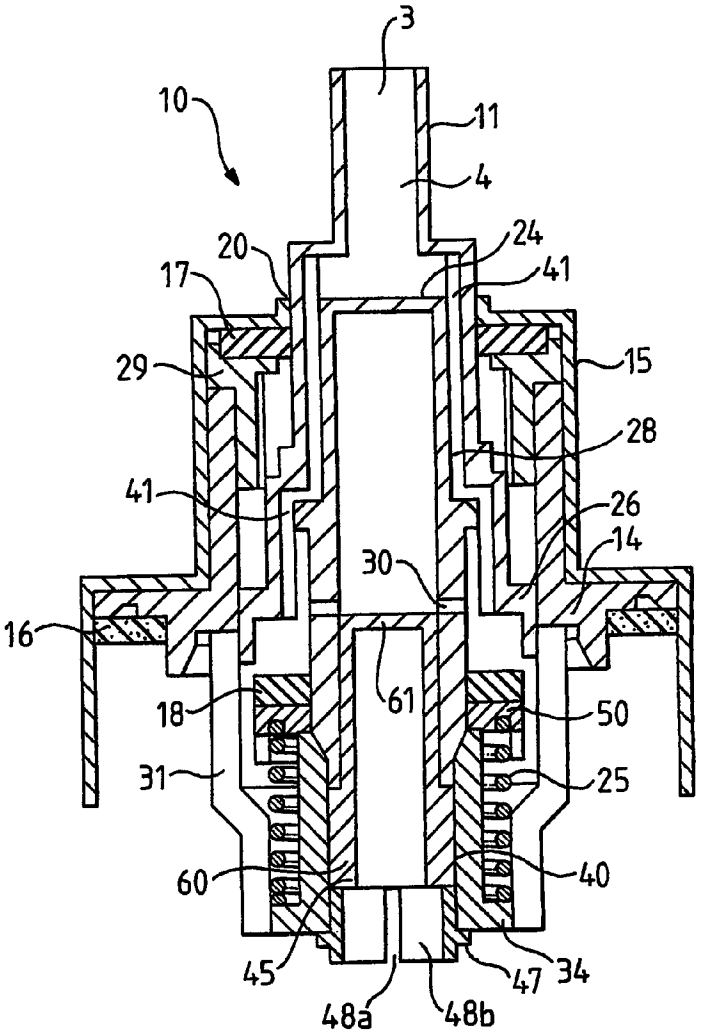
FIG. 8 is a cross-sectional view of the metering valve of FIG. 6 undergoing "pressure filling".
Figure 7:
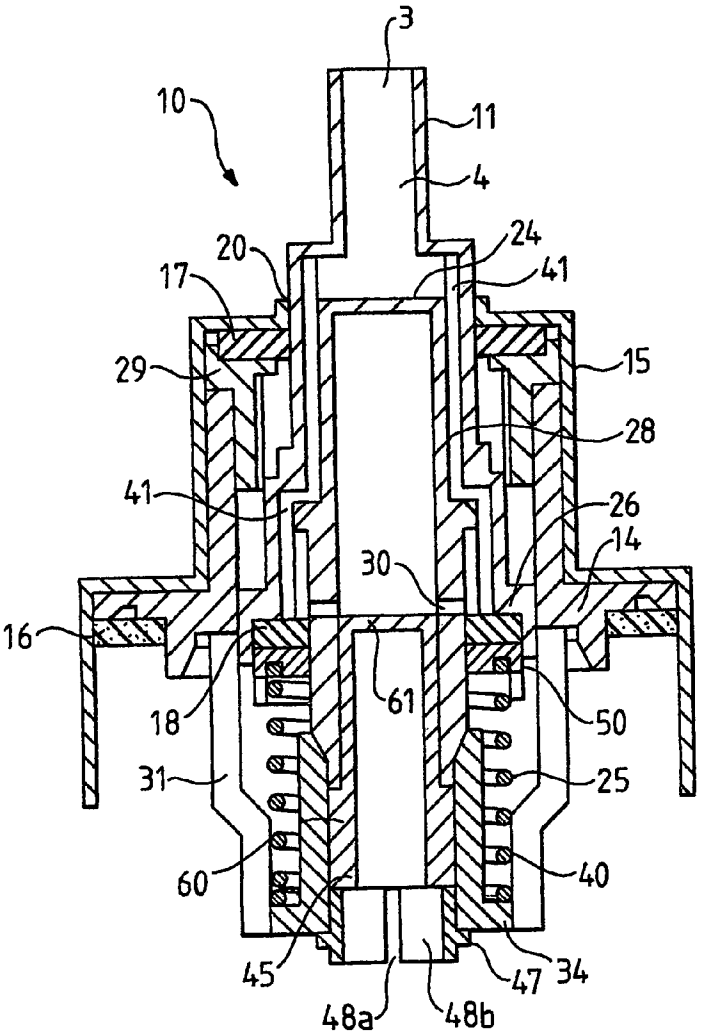
FIG. 7 is a cross-sectional view of the metering valve of FIG. 6 in a dispensing position.

FIGS. 6 to 8 show a second embodiment of metering valve according to the present invention. Like reference numerals have been used for like components of the first embodiment. The valve 10 includes a valve stem 11 which protrudes from and is axially slidable within a valve body 14. The valve stem 11 defines a hollow bore 4 having a discharge outlet 3 at its upper end. A chamber body 24 is slidably received in an inner end 26 of the valve stem 11, which chamber body 24 is cup-shaped with an outer wall 28 which has a stepped profile. The interior surface of the valve stem 11 is provided with one or more longitudinal recesses 41 which result in the valve stem's interior having a ridged surface. The longitudinal recesses 41 form pathways or conduits between the valve stem 11 and the chamber body 24.

The chamber body 24 forms one of two components defining a metering chamber 13 within the valve stem 11. The other component is a plug 45 described below. The chamber 13 has a predefined volume which corresponds to a single dosage of the product to be dispensed. The chamber body 24 is also provided with one or more inlets 30 at an inner end of the chamber body 24, i.e. furthest from the outlet 3. As with the first embodiment, locating the inlets 30 at the innermost end of the valve helps to prevent entrapment of gas bubbles in the metering chamber on inversion of the valve prior to use.

An outer seal 17 is provided between the valve stem 11 and the valve body 14 which seal 17 is in the form of an annular ring. The outer seal 17 is supported by an annular insert 29 located adjacent the valve body 14. The outer seal 17 is in sliding contact with the valve stem 11.

A base 34 of the valve body 14 is provided with an annular tubular extension 40 which extends into the interior of the valve 10 and which is shaped so as to receive an inner end 46 of the chamber body 24. The inner end 46 is provided with a plurality of slots 48*a* defining a series of legs 48*b* of the chamber body 24. When the chamber body 24 is engaged in the tubular extension 40 the legs 48*b* flex together to accommodate the engagement. When the inner end 46 passes beyond the inner end of the tubular extension 40 the legs 48*b* snap back into place. The chamber body 24 is provided with detents 47 to prevent retraction of the chamber body 24 through the tubular extension 40. The detents 47 also hold the chamber body 24 in fixed spatial relationship to the valve body 14.

The plug 45 is then inserted into the inner end 46 of the chamber body 24. The plug 45 comprises external ribs 60 which are received in the slots 48*a*. The plug 45 is retained as an interference fit. An upper end 61 of the plug defines the inner end of the metering chamber 13.

The valve body 14 is positioned within a canister (not shown) containing a product to be dispensed. An inner end of the valve body 14 comprises openings 31 which allow passage of the product from the container into the interior of the valve body 14 and vice versa. The valve 10 is held in position with respect to the canister by means of a ferrule 15 which is crimped to the top of the canister. Sealing between the valve body 14 and the canister is provided by an annular gasket 16. The ferrule 15 is also provided with an aperture 20 through which an outer end 19 of the valve stem 11 protrudes.

An annular inner seal 18, typically of an elastomeric material, is located around the chamber body 24 in close proximity to the inner end 26 of the valve stem 11. The inner seal 18 is slidably moveable over the chamber body 24.

A spring 25 extends between the base 34 of the valve body 14 and a seal carriage 50 positioned beneath the inner seal 18.

The spring 25 biases the seal carriage 50 upwardly against the inner seal 18 to hold the inner seal 18 in contact with the inner end 26 of the valve stem 11, as shown in FIG. 6. Consequently, the spring 25 also biases the valve stem 11 into the non-dispensing position. The metering chamber 13 is, in the non-dispensing position of FIG. 6, sealed from the atmosphere by means of the inner seal 18 which prevents leakage between the chamber body 24 and the valve stem 11 and by means of the outer seal 17 which prevents leakage between the valve stem 11 and the valve body 14 or ferrule 15.

The metering valve 10 and the canister together form a dispensing apparatus. In the non-dispensing position of FIG. 6, there is no open path from the metering chamber 13 to the bore 4 of the valve stem 11. An open path is established from the canister to the metering chamber 13 via the openings 31 in the inner end of the valve body 14 and the inlets 30.

In use, the dispensing apparatus is inverted such that the valve stem 11 is lowermost in order that the liquified propellant in the pressurised dispensing container collects at the end of the pressurised dispensing container adjacent the metering valve 10 so as to flow into the metering chamber 13 via the aforementioned open pathway.

The metering valve 10 is actuated by depression of the valve stem 11 relative to the valve body 14. Upon depression the valve stem 11 moves inwardly into the valve and consequently moves relative to the chamber body 24. This movement causes the inner seal 18 to pass across the inlets 30 as shown in FIG. 7 cutting off communication with the canister and establishing an outlet pathway from the metering chamber 13 to the bore 4 of the valve stem 11 via the inlets 30 and the longitudinal recesses 41 formed on the interior surface of the valve stem 11. Establishment of the outlet pathway allows the product in the metering chamber 13 to be discharged to the atmosphere by volatilisation of the liquified propellant.

When the valve stem 11 is released, the biasing of the spring 25 causes the seal carriage 50, inner seal 18 and valve stem 11 to return to their original positions. As a result, the inner seal 18 returns to its non-dispensing position above the inlet 30 allowing product in the pressurised dispensing container to pass into the metering chamber 13 on the next inversion of the apparatus in order to recharge the chamber in readiness for further dispensing operations.

If the dispensing apparatus is returned to its upright position, as shown in FIG. 6, the product to be dispensed is free to return to the pressurised container. However, upon inversion of the apparatus into a dispensing position, the metering chamber will very quickly be recharged prior to actuation of the valve 10.

Advantageously, the inner seal 18 and the outer seal 17 are located outside the metering chamber 13 and as such are not themselves components of the construction of the metering chamber 13. The outer seal 17 is remote from the metering chamber 13. The inner seal 18 operatively seals the ports 30 by closing off the ports 30 on the exterior face of the chamber body 24 which does not form a boundary surface of the metering chamber 13. Thus, the metering chamber volume is defined much more accurately since the metering chamber is defined by surfaces formed from materials which have high resistance to distortion and/or swelling. Indeed in the second embodiment the metering chamber is constructed from only two components, the chamber body 24 and the plug 45. A further advantage is that the metering chamber 13 does not contain any moving parts, in particular any part of the valve stem 11. Rather the metering chamber is located within the valve stem. This helps to maintain the integrity of the metering chamber 13.

In order to fill the container with a product prior to the first use of the dispensing apparatus, a pressure filling method is used, as shown in FIG. 8. During the filling process, the product is blown under pressure into the valve 10 via the outlet 3 of the valve stem 11 with the valve stem 11 held in the actuated position of FIG. 7. Under pressure the inner seal 18 is forced inwardly into the valve to thereby move past the inlets 30 of the chamber body 24, as shown in FIG. 8. This movement is accommodated by movement of the seal carriage 50 against the bias of the spring 25. Product is thus able to pass through the hollow bore 4 of the valve stem 11, along the longitudinal recesses 41 and through the apertures 31 in the inner part of the valve body 14.

As with the first embodiment the volume of the metering chamber may advantageously be chosen with a degree of flexibility. Preferably the metering chamber has a volume up to 125 microlitres where the chamber is within the valve stem. Advantageously, the metering chamber may have a volume up to 25 microlitres, preferably of 10 to 25 microlitres.

The seals 17 and/or 18 of both embodiments may be formed from material having acceptable performance characteristics. Preferred examples include nitrile, EPDM and other thermoplastic elastomers, butyl and neoprene.

Other rigid components of the metering valve of both embodiments, such as the valve body 14, internal sleeve 12, chamber body 24 and valve stem 11 may be formed, for example, from polyester, nylon, acetal or similar. Alternative materials for the rigid components include stainless steel, ceramics and glass.

The invention claimed is:

1. A metering valve comprising a valve stem co-axially slidable within a valve body, the metering valve comprising a metering chamber wherein the metering chamber is static and no part of the valve stem defines the metering chamber, and the metering chamber is constructed wholly from rigid components.

2. A metering valve as claimed in claim 1 wherein the metering chamber is constructed wholly from components formed from one or more materials selected from polyester, nylon, acetal, stainless steel, ceramics or glass.

3. A metering valve as claimed in claim 1 further comprising inner and outer seals external to the metering chamber.

4. A metering valve as claimed in claim 1 wherein the metering chamber is constructed from only two rigid components.

5. A metering valve as claimed in claim 1 wherein the components of the metering chamber comprises one or more stops for limiting axial movement of the valve stern therethrough.

6. A metering valve as claimed in claim 1 wherein the metering chamber surrounds the valve stem.

7. A metering valve as claimed in claim 1 wherein the metering chamber is annular.

8. A metering valve as claimed in any preceding claim wherein the valve body defines a radially outermost surface of the metering chamber.

9. A metering valve as claimed in claim 1 wherein the metering chamber has a dosage volume that is designed to correspond with a single dose discharge volume to be discharged by the metering valve when the metering valve is placed in an outlet access state.

10. A metering valve as claimed in claim 1 further comprising an internal sleeve.

11. A metering valve as claimed in claim 10 wherein the internal sleeve is located concentrically within the valve body.

12. A metering valve as claimed in claim 10 wherein the metering chamber is formed between the valve body and the internal sleeve.

13. A metering valve as claimed in claim 10 wherein the internal sleeve defines a radially innermost surface of the metering chamber.

14. A metering chamber as claimed in claim 10 wherein the internal sleeve comprises a cylindrical portion.

15. A metering valve as claimed in claim 10 wherein the inner seal is carried on the valve stem in sliding sealing contact with a radially innermost surface of the internal sleeve, being external the metering chamber.

16. A metering valve as claimed in claim 10 wherein a radially directed flange of the internal sleeve defines an outer end surface of the metering chamber.

17. A metering valve as claimed in claim 10 wherein the valve stem is adjustably received by the internal sleeve such that, when said metering valve is in use, said valve stem moves relative to a more stationary internal sleeve.

18. A metering valve as claimed in claim 10 wherein the internal sleeve surrounds the valve stem.

19. A metering valve as claimed in claim 18 wherein the internal sleeve separates the metering chamber from the valve stem.

20. A metering valve as claimed in claim 10 wherein the internal sleeve comprises one or more ports for passage of a product into or out of the metering chamber.

21. A metering valve as claimed in claim 20 wherein the one or more ports each function as both an inlet to, and an outlet from, the metering chamber in use.

22. A metering valve as claimed in claim 20 wherein the one or more ports are located at an inner end of the metering chamber.

23. A metering valve as claimed in claim 20 wherein the one or more ports are static.

24. A metering valve as claimed in claim 1 wherein the metering chamber has a volume of up to 300 microlitres.

25. A metering valve as claimed in claim 24 wherein the metering chamber has a volume up to 25 microlitres.

26. A metering valve as claimed in claim 25 wherein the metering chamber has a volume of 10 to 25 microlitres.

27. A metering valve comprising a valve stem co-axially slidable within a valve body, the metering valve comprising a metering chamber wherein the metering chamber is static in that it contains no part of the valve stem and is constructed wholly from rigid components, and said metering valve further comprising an internal sleeve, and wherein a radially directed flange of the valve body defines an inner end surface of the metering chamber.

28. A metering valve comprising a valve stem co-axially slidable within a valve body, the metering valve comprising a metering chamber wherein the metering chamber is static in that it contains no part of the valve stem and is constructed wholly from rigid components; and wherein the metering chamber is located within the valve stem such that product held in the metering chamber is dischargeable directly into the valve stem.

29. A metering valve as claimed in claim 28 wherein the metering chamber is cylindrical.

30. A metering valve as claimed in claim 28 wherein the metering chamber comprises one or more ports which each function as both an inlet to, and an outlet from, the metering chamber in use.

31. A metering valve as claimed in claim 30 wherein the one or more ports are located at an inner end of the metering chamber.

32. A metering valve as claimed in claim 28 further comprising a seal which is movable relative to the metering chamber to close off said one or more ports, wherein said seal is external to said metering chamber.

33. A metering valve as claimed in claim 32 wherein said seal surrounds said metering chamber.

34. A metering valve as claimed in claim 28 wherein the metering chamber is constructed from an open-ended chamber body and a plug.

35. A metering valve as claimed in claim 34 wherein the chamber body is substantially located within the valve stem.

36. A metering valve comprising a valve stem co-axially slidable within a valve body, the metering valve comprising a metering chamber wherein the metering chamber is static in that it contains no part of the valve stem and is constructed wholly from rigid components; and wherein the metering chamber has no moving parts therein.

37. A metering valve comprising a valve stem co-axially slidable within a valve body, the metering valve comprising a metering chamber wherein the metering chamber is static in that it contains no part of the valve stem and is constructed wholly from rigid components, and said metering valve further comprising one or more seals, and said metering chamber being arranged as to preclude any seal material from bounding and defining the metering chamber.

38. A metering valve as recited in claim 37, further comprising a product, which product is contained in said metering chamber, and which product is a pharmaceutical product comprising a propellant.

* * * * *